US010784552B2

(12) United States Patent
Otsuki

(10) Patent No.: US 10,784,552 B2
(45) Date of Patent: Sep. 22, 2020

(54) HIGH-FREQUENCY POWER COMBINER

(71) Applicants: Kabushiki Kaisha Toshiba, Tokyo (JP); Toshiba Infrastructure Systems & Solutions Corporation, Kanagawa (JP)

(72) Inventor: Shunya Otsuki, Tokyo (JP)

(73) Assignees: Kabushiki Kaisha Toshiba, Tokyo (JP); Toshiba Infrastructure Systems & Solutions Corporation, Kanagawa (JP)

( * ) Notice: Subject to any disclaimer, the term of this patent is extended or adjusted under 35 U.S.C. 154(b) by 7 days.

(21) Appl. No.: 16/134,468

(22) Filed: Sep. 18, 2018

(65) Prior Publication Data

US 2019/0089032 A1 Mar. 21, 2019

(30) Foreign Application Priority Data

Sep. 20, 2017 (JP) ..... 2017-180274
Sep. 14, 2018 (JP) ..... 2018-172719

(51) Int. Cl.

| | |
|---|---|
| ***H01P 1/30*** | (2006.01) |
| ***H01P 3/08*** | (2006.01) |
| ***H01P 5/16*** | (2006.01) |
| ***F28D 15/02*** | (2006.01) |

(52) U.S. Cl.

CPC ..... *H01P 1/30* (2013.01); *H01P 3/08* (2013.01); *H01P 5/16* (2013.01); *F28D 15/02* (2013.01)

(58) Field of Classification Search

CPC ..... H01P 1/30; H01P 3/08; H01P 5/16; F28D 15/02
USPC ..... 333/128
See application file for complete search history.

(56) References Cited

U.S. PATENT DOCUMENTS

| | | | | |
|---|---|---|---|---|
| 5,324,886 | A | 6/1994 | Nakatake et al. | |
| 2012/0062335 | A1* | 3/2012 | Sherrer | H01P 5/12 333/127 |
| 2016/0190672 | A1 | 6/2016 | Gudovich et al. | |

FOREIGN PATENT DOCUMENTS

| | | | |
|---|---|---|---|
| CN | 1048767 | A | 1/1991 |
| CN | 206422208 | U | 8/2017 |
| JP | 04-067802 | U1 | 6/1992 |
| JP | 11-284410 | A | 10/1999 |
| JP | 2016528836 | A | 9/2016 |

* cited by examiner

*Primary Examiner* — Robert J Pascal
*Assistant Examiner* — Kimberly E Glenn
(74) *Attorney, Agent, or Firm* — Baker Botts L.L.P.

(57) ABSTRACT

According to one embodiment, a high-frequency power combiner has an external conductor and an internal conductor. The external conductor defines an internal space. The internal conductor has an output-side line and a plurality of input-side lines that branch off from the output-side line. The internal conductor is provided in the internal space of the external conductor. The high-frequency power combiner of the embodiment has a structure that can store a liquid in contact with the internal conductor in the internal space.

5 Claims, 5 Drawing Sheets

HIGH-FREQUENCY POWER COMBINER

CROSS-REFERENCE TO RELATED APPLICATION

This application claims priority from Japanese Patent Application No. 2017-180274 filed on Sep. 20, 2017 and Japanese Patent Application No. 2018-172719 filed on Sep. 14, 2018, the contents of which are incorporated herein by reference in their entirety.

FIELD

Embodiments described herein relate generally to a high-frequency power combiner.

BACKGROUND

A high-frequency power combiner for combining high-frequency outputs is used, for example, in a television broadcasting transmitter or the like to output high power. The high-frequency power combiner is difficult to miniaturize because an internal conductor (a high-frequency line) easily generates heat.

DETAILED DESCRIPTION

According to one embodiment, a high-frequency power combiner has an external conductor and an internal conductor. The external conductor defines an internal space. The internal conductor has an output-side line and a plurality of input-side lines that branch off from the output-side line. The internal conductor is provided in the internal space of the external conductor. The high-frequency power combiner of the embodiment has a structure that can store a liquid in contact with the internal conductor in the internal space.

Hereinafter, the high-frequency power combiner of the embodiment will be described with reference to the drawings.

Figure 1:
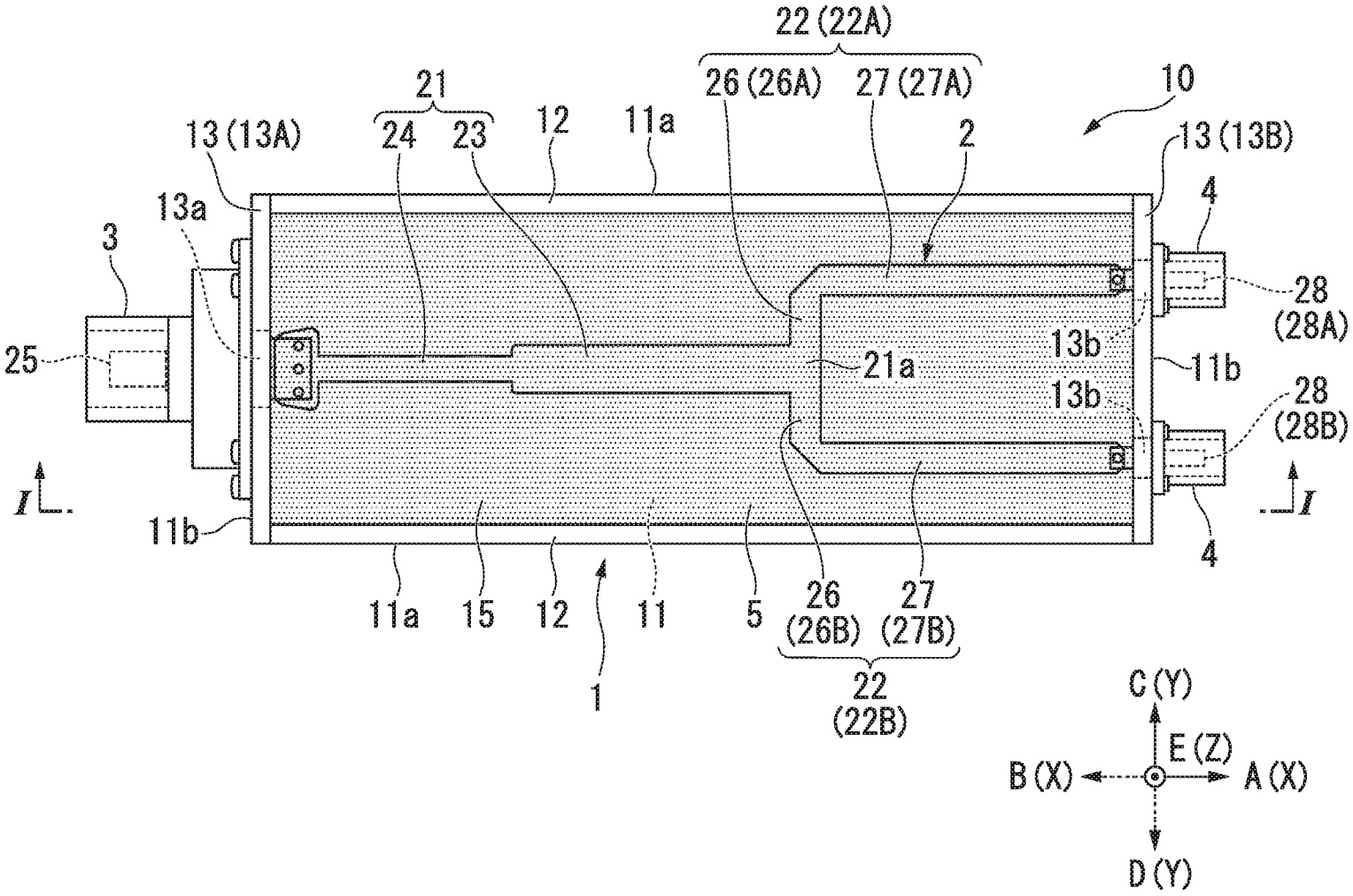
FIG. 1 is a plan view schematically showing a constitution of a high-frequency power combiner of an embodiment.
Figure 2:
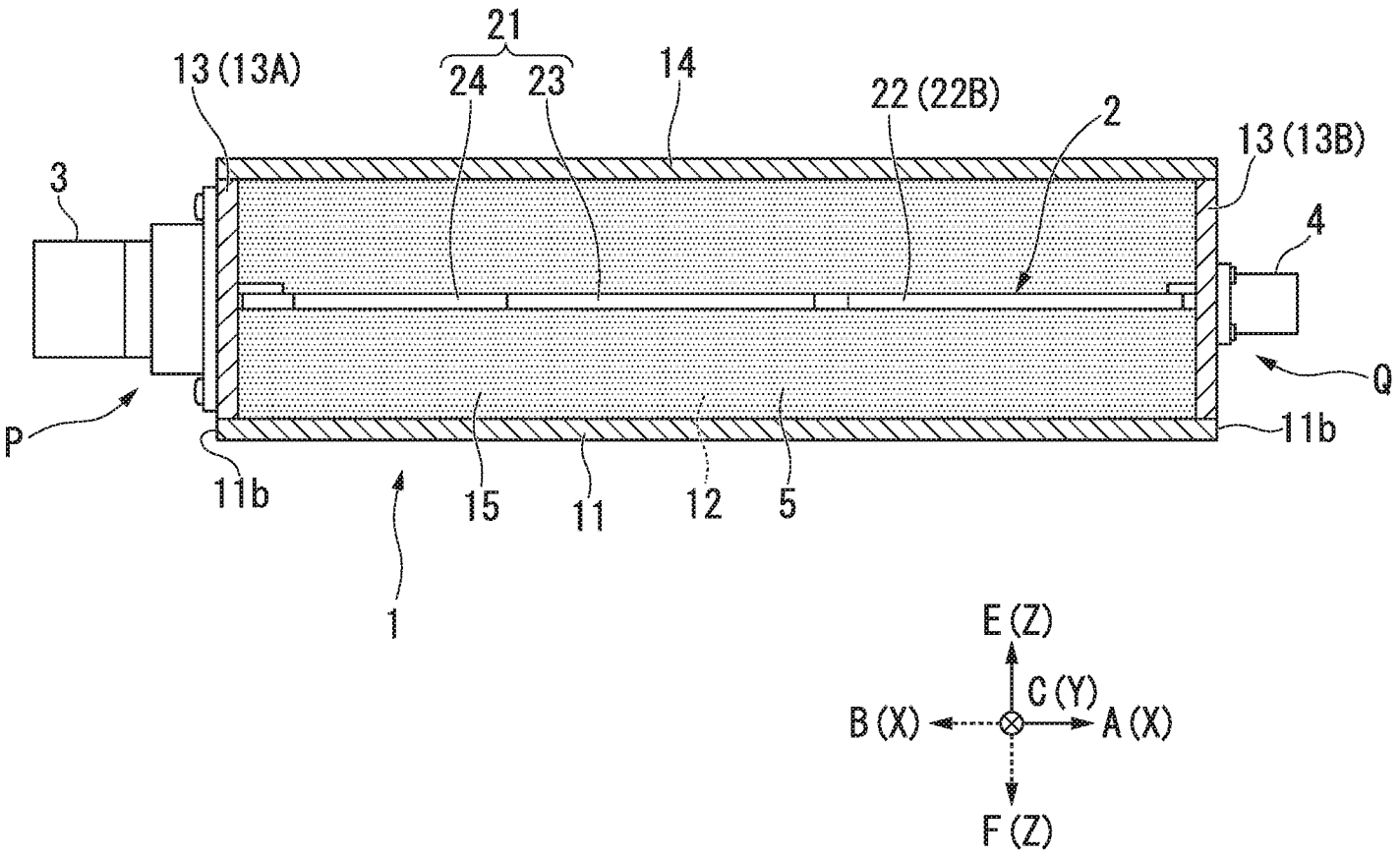
FIG. 2 is a cross-sectional side view schematically showing the constitution of the high-frequency power combiner of the embodiment.

FIG. 1 is a plan view schematically showing a constitution of a high-frequency power combiner 10 of an embodiment. FIG. 2 is a cross-sectional view schematically showing the constitution of the high-frequency power combiner 10 of the embodiment. FIG. 2 shows a cross section taken along the line I-I of FIG. 1. In FIGS. 1 and 2, an X direction is a length direction of a bottom plate 11 of the external conductor 1. A Y direction is a direction orthogonal to the X direction in a plane along the bottom plate 11, and a width direction of the bottom plate 11. A Z direction is a direction orthogonal to the X and Y directions, and a thickness direction of the bottom plate 11. In the following description, the Z direction is also referred to as a vertical direction or a height direction. A plan view refers to a view in the Z direction. In FIG. 1, a top plate 14 is not shown.

In the following explanation, it is assumed that the high-frequency power combiner 10 has a posture in which a top plate 14 is located at an upper side with respect to a bottom plate 11, and a positional relationship between various members of the high-frequency power combiner 10 will be described. Note that, the posture of the high-frequency power combiner 10 is only provisionally set for convenience of explanation. Therefore, the posture of the high-frequency power combiner 10 in this embodiment is not limited to a posture of the high-frequency power combiner during use.

One side in the X direction is referred to as an A direction, and a direction of the other side in the X direction is referred to as a B direction. One side in the Y direction is referred to as a C direction, and a direction of the other side in the Y direction is referred to as a D direction. One side in the Z direction is referred to as an E direction, and a direction of the other side in the Z direction is referred to as an F direction. The E direction is an upper side. A plane defined by the X and Y directions is referred to as an XY plane. A plane defined by the X and Z directions is referred to as an XZ plane. A plane defined by the Y and Z directions is referred to as a YZ plane.

As shown in FIGS. 1 and 2, the high-frequency power combiner 10 includes an external conductor 1, an internal conductor 2, an output-side terminal 3, and input-side terminals 4 and 4.

The external conductor 1 includes a bottom plate 11, lateral plates 12 and 12, end plates 13 and 13, and a top plate 14 (see FIG. 2), and is formed in a container shape.

As shown in FIG. 1, the bottom plate 11 has a rectangular shape, for example an oblong shape, in a plan view. The lateral plates 12 and 12 are vertically arranged on lateral edges 11*a* and 11*a* of the bottom plate 11. The lateral plates 12 and 12 are formed along the XZ plane. The end plates 13 and 13 are vertically arranged on end edges 11*b* and 11*b* of the bottom plate 11. The end plates 13 and 13 are formed along the YZ plane.

As shown in FIG. 2, the top plate 14 is provided on upper ends of the lateral plates 12 and the end plates 13. The top plate 14 is formed along the XY plane. A space surrounded by the bottom plate 11, the lateral plates 12 and 12, the end plates 13 and 13, and the top plate 14 is referred to as an internal space 15. The external conductor 1 defines the internal space 15.

Lower ends of the lateral plates 12 and lower ends of the end plates 13 are liquid-tightly connected to a periphery of the bottom plate 11.

Upper ends of the lateral plates 12 and upper ends of the end plates 13 are liquid-tightly connected to a periphery of the top plate 14. Ends of the lateral plates 12 and lateral edges of the end plates 13 are joined liquid-tightly. For this reason, the external conductor 1 can store a liquid (a heat carrier) 5 in the internal space 15.

Among the bottom plate 11, the lateral plates 12 and 12, the end plates 13 and 13, and the top plate 14, the two or more neighboring plates may be integrally formed. For example, the bottom plate 11, the lateral plates 12 and 12, and the end plates 13 and 13 may be integrally formed. As will be described below, the external conductor 1 can store the liquid 5 in contact with the internal conductor 2.

The external conductor 1 may have a sealed structure. When the external conductor 1 has sealed structure, leakage and evaporation of the liquid 5 can be prevented. In addition, a pressure in the external conductor 1 can be constantly maintained.

The bottom plate 11 and the top plate 14 are formed of a conductive material in part or in whole. Examples of the conductive material are preferably metals such as aluminum (or an aluminum alloy), copper (or a copper alloy), and so on. The bottom plate 11 and the top plate 14 are grounded via a connecting line (not shown in the figure), and thus the external conductor 1 is a ground conductor.

An insertion hole 13*a* through which an end conductor 25 is inserted is formed in one end plate 13 (13A) of the pair of end plates 13 and 13. An inner diameter of the insertion hole 13*a* is larger than an external size of the end conductor 25. A pair of insertion holes 13*b* and 13*b* through which end conductors 28 and 28 are inserted are formed in the other end plate 13 (13B). Inner diameters of the insertion holes 13*b* are larger than external sizes of the end conductors 28.

Figure 3:
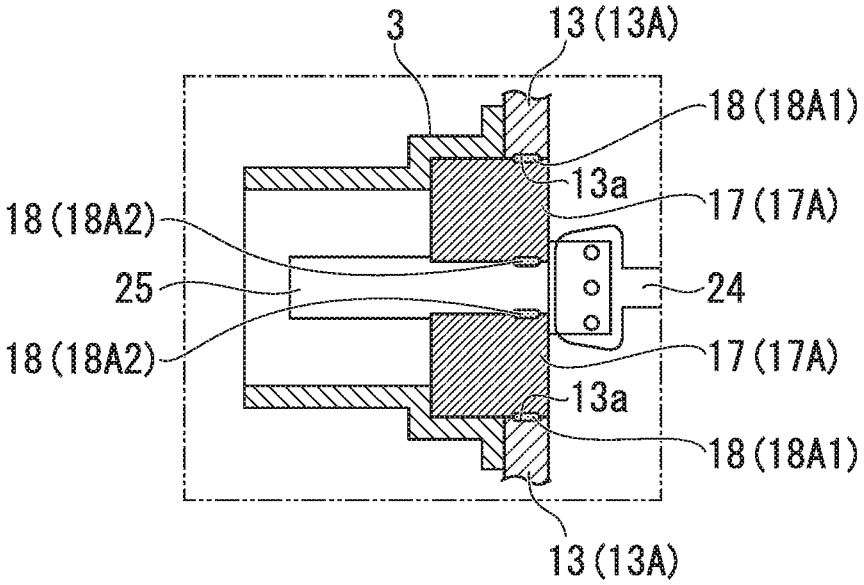
FIG. 3 is a cross-sectional view showing an output-side terminal of the high-frequency power combiner of the embodiment.

FIG. 3 is a cross-sectional view showing the output-side terminal 3. As shown in FIG. 3, the output-side terminal 3 is formed in a substantially tubular shape (e.g., a cylindrical shape), and is provided on an outer surface of the end plate 13 (13A). The output-side terminal 3 is provided at a position matched with the insertion hole 13*a*. The end conductor 25 is inserted through the output-side terminal 3. An annular interposing member 17 (17A) is provided inside the output-side terminal 3 and the insertion hole 13*a*. The output-side terminal 3 is in contact with the outer surface of the end plate 13 (13A) and is thereby electrically connected to the end plate 13 (13A).

An annular packing 18 (18A1) (closing member) is provided between the inner peripheral face of the insertion hole 13*a* and the outer peripheral face of the interposing member 17 (17A). An annular packing 18 (18A2) (closing member) is provided between the inner peripheral face of the interposing member 17 (17A) and the outer peripheral face of the end conductor 25. The interposing member 17 (17A) and the packings 18 (18A1, 18A2) liquid-tightly close the insertion hole 13*a*. Accordingly, it is possible to prevent the liquid 5 in the external conductor 1 from leaking out of the insertion hole 13*a*.

Figure 4:
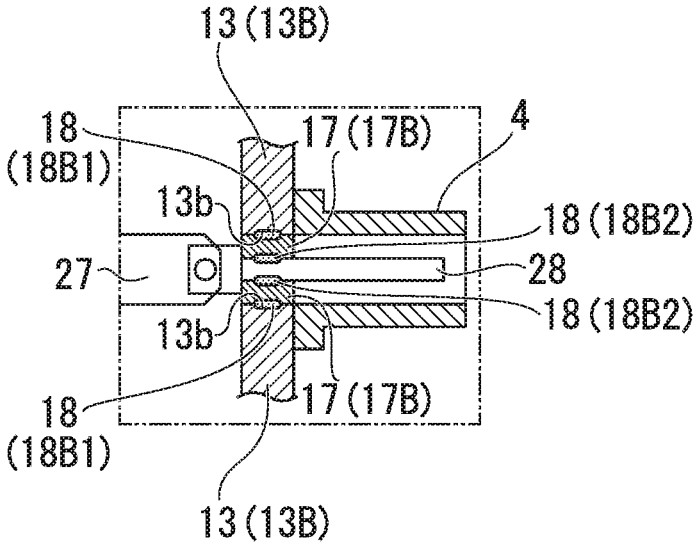
FIG. 4 is a cross-sectional view showing an input-side terminal of the high-frequency power combiner of the embodiment.

FIG. 4 is a cross-sectional view showing the input-side terminal 4. As shown in FIG. 4, the input-side terminal 4 is formed in a substantially tubular shape (e.g., a cylindrical shape), and are provided on an outer surface of the end plate 13 (13B). The input-side terminals 4 are provided at positions matched with the insertion holes 13*b*. The end conductors 28 are inserted through the input-side terminals 4. An annular interposing member 17 (17B) is provided inside the insertion hole 13*b*. The input-side terminals 4 in contact with the outer surface of the end plate 13 (13B) and is thereby electrically connected to the end plate 13 (13B).

The interposing member 17 (17A and 17B) is an insulator formed of a resin (e.g., Teflon (registered trademark), a polyolefin resin, or the like), a rubber, or the like. The packing 18 is formed of a soft resin (a polyolefin resin or the like), a rubber, or the like, and can be elastically deformed.

An annular packing 18 (18B1) (closing member) is provided between the inner peripheral face of the insertion hole 13*b* and the outer peripheral face of the interposing member 17 (17B). An annular packing 18 (18B2) (closing member) is provided between the inner peripheral face of the interposing member 17 (17B) and the outer peripheral face of the end conductor 28. The interposing member 17 (17B) and the packings 18 (18B1, 18B2) liquid-tightly close the insertion hole 13*b*. Accordingly, it is possible to prevent the liquid 5 in the external conductor 1 from leaking out of the insertion hole 13*b*.

The end plates 13 are formed of a metal such as aluminum (or an aluminum alloy), copper (or a copper alloy), or the like.

As shown in FIGS. 1 and 2, the internal conductor 2 includes an output-side line 21 and a pair of input-side lines 22 and 22.

The output-side line 21 includes a first line 23 and a second line 24. The first line 23 extends in the X direction. The first line 23 has an electric length that corresponds to, for example, a quarter of an operating wavelength. The second line 24 extends in the B direction from an end of the first line 23 which is directed in the B direction. A width (a size in the Y direction) of the second line 24 is smaller than that of the first line 23. The first line 23 and the second line 24 are formed in a plate shape following the XY plane.

The end conductor 25 is connected to an end of the second line 24 which is directed in the B direction. The end conductor 25 extends in the B direction from the end of the second line 24 which is directed in the B direction, and is inserted through the insertion hole 13*a* of the end plate 13 (13A).

As shown in FIG. 1, input-side lines 22 and 22 are branch lines that are formed by branching off from an end 21*a* of the output-side line 21 which is directed in the A direction as a branching point into two pieces.

One input-side line 22 (22A) of the input-side lines 22 and 22 includes a first line 26 (26A) and a second line 27 (27A). The first line 26 (26A) extends in the C direction starting from the end 21*a* of the output-side line 21. The second line 27 (27A) extends in the A direction from an end of the first line 26 (26A) which is directed in the C direction. The first line 26 (26A) and the second line 27 (27A) are formed in a plate shape following the XY plane.

The end conductor 28 (28A) is connected to an end of the second line 27 (27A) which is directed in the A direction. The end conductor 28 (28A) extends in the A direction from the end of the second line 27 (27A) which is directed in the A direction, and is inserted through the insertion hole 13*b* of the end plate 13 (13B).

The other input-side line 22 (22B) of the input-side lines 22 and 22 includes a first line 26 (26B) and a second line 27 (27B). The first line 26 (26B) extends in the D direction starting from the end 21*a* of the output-side line 21. The second line 27 (27B) extends in the A direction from an end of the first line 26 (26B) which is directed in the D direction. The first line 26 (26B) and the second line 27 (27B) are formed in a plate shape following the XY plane.

The end conductor 28 (28B) is connected to an end of the second line 27 (27B) which is directed in the A direction. The end conductor 28 (28B) extends in the A direction from the end of the second line 27 (27B) which is directed in the A direction, and is inserted through the insertion hole 13*b* of the end plate 13 (13B).

The internal conductor 2 is formed of a conductive material. Examples of the conductive material are preferably metals such as copper (or a copper alloy), aluminum (or an aluminum alloy), and so on. The output-side line 21 and the input-side lines 22 and 22 are integrally formed.

The high-frequency power combiner 10 is a combiner in which the transmission lines (the output-side line 21, the input-side lines 22 and 22, and so on) are formed of a stripline.

The high-frequency power combiner 10 may be, for example, an impedance conversion type combiner in which output impedance and input impedance are matched (subjected to impedance matching) by the internal conductor 2.

As shown in FIG. 2, the internal conductor 2 is disposed in the internal space 15. The internal conductor 2 is located at a height position at which it is separated from the bottom plate 11 and the top plate 14. That is, the internal conductor 2 is located at a position at which it is higher than the bottom plate 11 and is lower than the top plate 14.

The liquid 5 is stored in the internal space 15 of the external conductor 1.

As the liquid 5, a heat carrier having an insulation property at an operating temperature (e.g., 25° C.) is preferred. For example, a fluorine inactive liquid, a hydrocarbon insulating oil, a silicone oil, or the like is used as the liquid 5. Fluorinert FC-770 (registered trademark) or the like available from 3M can be used as the fluorine inactive liquid. Main components of the hydrocarbon insulating oil are, for example alkylbenzene, polybutene, alkylnaphthalene, and so on.

Dielectric strength (2.54 mm gap) of the liquid 5 is, for example, 38 kV to 46 kV at 25° C. A boiling point of the liquid 5 is, for example, 50° C. or higher and 180° C. or lower. Permittivity at a frequency of 1 kHz is 1.76 to 1.90 at 25° C.

The liquid 5 is stored in the internal space 15 to be able to be in contact with the internal conductor 2. In FIG. 1 or the like, the entire internal space 15 is filled with the liquid 5. However, when the liquid 5 has an amount smaller than a volume of the internal space 15, a surface of the liquid 5 is located lower than an uppermost portion of the internal space 15.

The liquid 5 may be in contact with only a part of the internal conductor 2, but the entire internal conductor 2 is preferably immersed in the liquid 5. When the entire internal conductor 2 is immersed in the liquid 5, cooling efficiency of the internal conductor 2 can be improved.

When the internal conductor 2 generates heat due to energization, the liquid 5 is reduced in specific gravity due to a rise in temperature, and thus the liquid 5 is subjected to natural convection (thermal convection) in the internal space 15. Due to the convection of the liquid 5, the internal conductor 2 is efficiently cooled.

When the liquid 5 has an amount smaller than a maximum volume formed by the internal space 15, a space is secured between the surface of the liquid 5 and a part (e.g., the lateral plates 12) of the external conductor 1. For this reason, so-called ebullient cooling that boils the liquid 5 to increase a cooling effect based on latent heat becomes possible.

In the high-frequency power combiner 10, the internal conductor 2 can be efficiently cooled by the liquid 5 stored in the internal space 15. For this reason, the internal conductor 2 can be made smaller (e.g., thinner or narrower) without causing an excessive rise in temperature. Accordingly, the high-frequency power combiner 10 can be miniaturized. For example, a thickness (a size in the Z direction) of the high-frequency power combiner 10 can be reduced.

A dielectric is used as the insulating liquid 5, and thereby electric lengths of the output-side line 21 and the input-side lines 22 and 22 become short compared to a case in which the liquid 5 is not used. For this reason, a size of the internal conductor 2 in the X direction can be reduced. Therefore, a length (a size in the X direction) of the high-frequency power combiner 10 can be reduced. Thus, the high-frequency power combiner 10 can be further miniaturized.

Because an external conductor in a general-purpose high-frequency power combiner can be used as the external conductor 1 in the high-frequency power combiner 10, a manufacturing cost can be reduced.

The high-frequency power combiner 10 in which the internal space 15 of the external conductor 1 is filled with the heat carrier 5 is configured to include the external conductor 1, the internal conductor 2, the output-side terminal 3, the input-side terminals 4 and 4, and the heat carrier 5.

Figure 5:
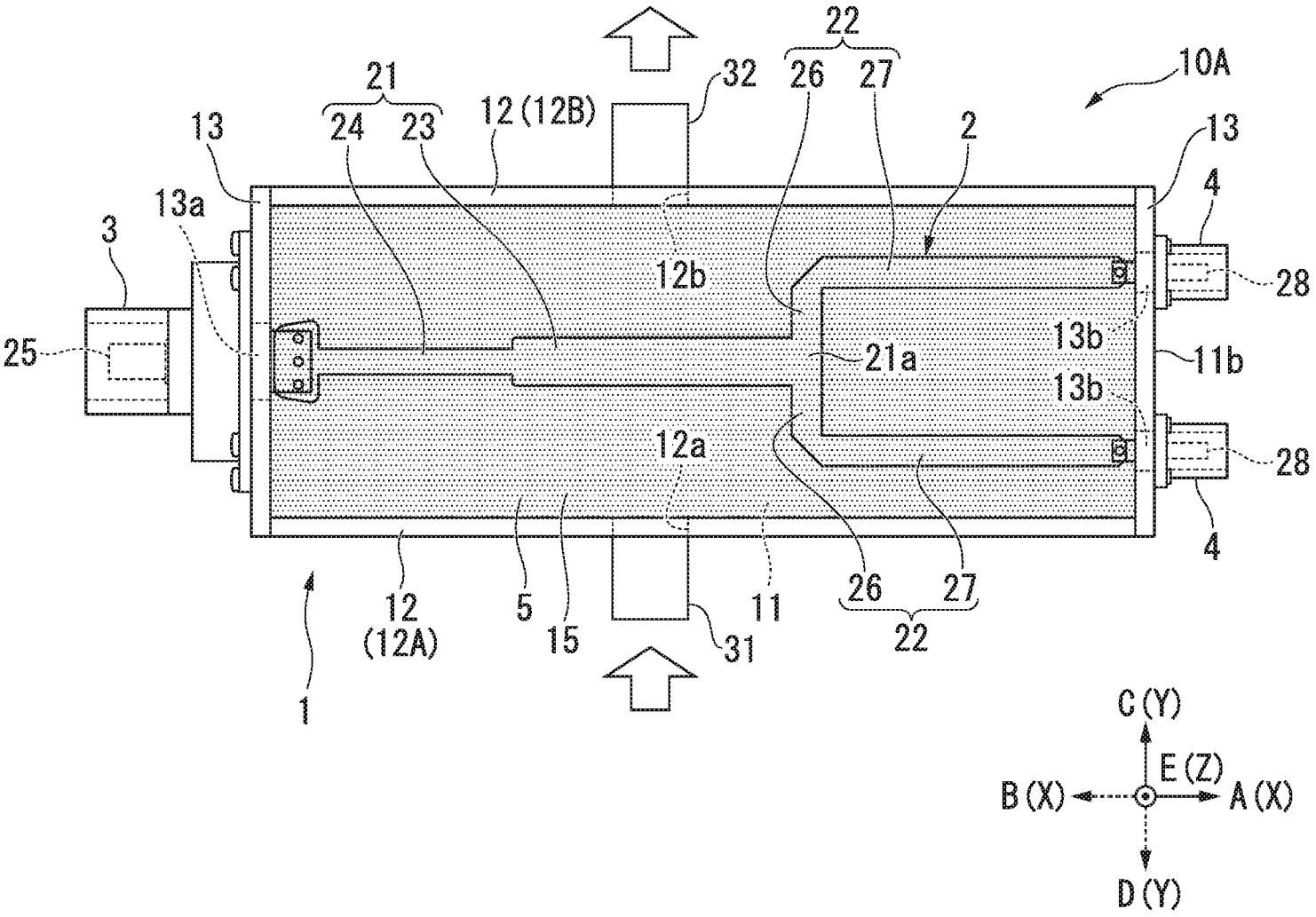
FIG. 5 is a plan view schematically showing a modified example of the high-frequency power combiner of the embodiment.

FIG. 5 is a plan view schematically showing a constitution of a high-frequency power combiner 10A of another embodiment. In FIG. 5, the top plate 14 is not shown.

As shown in FIG. 5, in the high-frequency power combiner 10A, one lateral plate 12A of a pair of lateral plates 12 and 12 is provided with an inflow passage 31 of a liquid 5. The inflow passage 31 is formed, for example, in a tubular shape. The inflow passage 31 can introduce the liquid 5 from a supply source (not shown in the figure) into an internal space 15 of an external conductor 1 through an inflow hole 12*a* of the lateral plate 12A.

The other lateral plate 12B of the lateral plates 12 and 12 is provided with an outflow passage 32 of the liquid 5.

The outflow passage 32 is formed, for example, in a tubular shape. The outflow passage 32 can lead the liquid 5 of the internal space 15 of the external conductor 1 to the outside of the external conductor 1 through an outflow hole 12*b* of the lateral plate 12B.

In the high-frequency power combiner 10A, efficiency of the liquid 5 cooling the internal conductor 2 can be increased by causing the liquid 5 supplied from the outside to circulate in the internal space 15 of the external conductor 1.

The heat carrier 5 led out by the outflow passage 32 may be cooled by a heat exchanger (not shown in the figure), and be reused through the inflow passage 31.

The high-frequency power combiners of the embodiments may adopt a structure of a 3 dB coupler type, a Wilkinson type, a rat race type, or the like.

The number of input-side lines that branch off from one output-side line in an internal conductor is not limited to two, and may be an arbitrary number of three or more.

Each of the high-frequency power combiners 10 and 10A of the embodiments is configured such that the external conductor 1 can store the liquid 5, but the configuration of the high-frequency power combiner is not limited thereto. For example, each of the high-frequency power combiners of the embodiments need not have a structure in which the external conductor can store the liquid as long as it includes a component in which the liquid in contact with the internal conductor can be stored in the internal space (e.g., a container-shaped intermediate structure provided in the external conductor), in addition to the external conductor.

Figure 6:
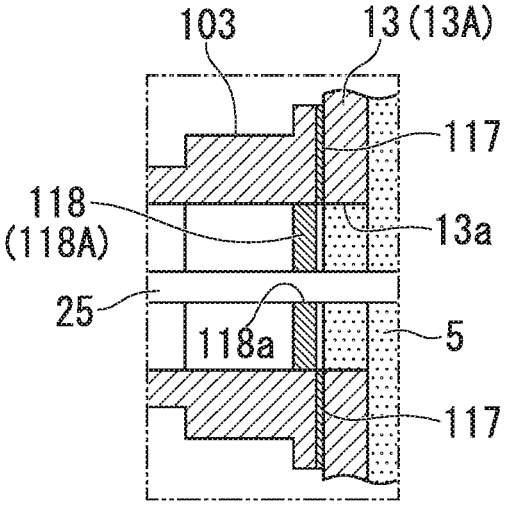
FIG. 6 is a cross-sectional view showing a modified example of the output-side terminal.

FIG. 6 is a cross-sectional view showing an output-side terminal 103 serving as a modified example of the output-side terminal 3. As shown in FIG. 6, the output-side terminal 103 is formed in a substantially tubular shape (e.g., a cylindrical shape), and is provided on an outer surface of the end plate 13 (13A). The output-side terminal 103 is provided at a position matched with the insertion hole 13*a*. The end conductor 25 is inserted through the output-side terminal 103. The output-side terminal 103 is mounted on the outer surface of the end plate 13 (13A) via an annular interposing member 117. The output-side terminal 103 is electrically connected to the end plate 13 (13A) at a connection point which is not shown in the figure.

An annular packing 118 (118A) (closing member) is provided inside the output-side terminal 103. The packing 118 is formed of a soft resin (a polyolefin resin or the like), a rubber, or the like, and can be elastically deformed. The packing 118 has an insertion hole 118*a* through which an end conductor 25 is inserted. An outer peripheral face of the packing 118 is in contact with an inner peripheral face of the output-side terminal 103 without a gap. An inner peripheral face of the packing 118 is in contact with an outer peripheral face of the end conductor 25 without a gap. The insertion hole 13*a* is liquid-tightly closed by the packing 118, the output-side terminal 103, and the interposing member 117, and thus the liquid 5 in the external conductor 1 can be prevented from leaking out of the insertion hole 13*a*.

Figure 7:
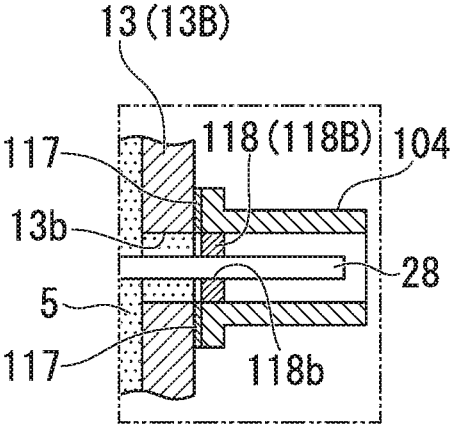
FIG. 7 is a cross-sectional view showing a modified example of the input-side terminal.

FIG. 7 is a cross-sectional view showing an input-side terminal 104 serving as a modified example of the input-side terminal 4. As shown in FIG. 7, the input-side terminal 104 is formed in a substantially tubular shape (e.g., a cylindrical shape), and is provided on an outer surface of the end plate 13 (13B). The input-side terminal 104 is provided at a position matched with the insertion hole 13*b*. The end conductor 28 is inserted through the input-side terminal 104. The input-side terminal 104 is mounted on the outer surface of the end plate 13 (13B) via an annular interposing member 117. The input-side terminal 104 is electrically connected to the end plate 13 (13B) at a connection point which is not shown in the figure.

An annular packing 118 (118B) (closing member) is provided inside the input-side terminal 104. The packing 118 has an insertion hole 118*b* through which an end conductor 28 is inserted. An outer peripheral face of the packing 118 is in contact with an inner peripheral face of the input-side terminal 104 without a gap. An inner peripheral face of the packing 118 is in contact with an outer peripheral face of the end conductor 28 without a gap. The insertion hole 13*b* is liquid-tightly closed by the packing 118, the input-side terminal 104, and the interposing member 117, and thus the liquid 5 in the external conductor 1 can be prevented from leaking out of the insertion hole 13*b*.

The interposing member 117 is formed of a resin (e.g., Teflon (registered trademark), a polyolefin resin, or the like), a rubber, or the like. The output-side terminal 103 and the input-side terminals 104 come into contact with the outer surfaces of the end plates 13 via the interposing members 117 without a gap, and thus the leakage of the liquid 5 can be prevented.

The packings 118 may be provided in the insertion holes 13*a* and 13*b* of the end plates 13 while in contact with the inner circumferential surfaces of the insertion holes 13*a* and 13*b*. In this case, the insertion holes 13*a* and 13*b* are also closed, and the liquid 5 in the external conductor 1 can be prevented from leaking outside.

In the above explanation of the embodiment, although it is assumed that the high-frequency power combiner 10 has a posture in which a top plate 14 is located at an upper side with respect to a bottom plate 11, the posture of the high-frequency power combiner 10 is not particularly limited. For example, the high-frequency power combiner 10 may be used in a posture in which one of the lateral plates 12 is located at an upper side with respect to the other of the lateral plates 12.

According to the embodiments described above, since the liquid 5 coming into contact with the internal conductor 2 can be stored, the internal conductor 2 can be efficiently cooled by the liquid 5 filling the internal space 15. For this reason, the internal conductor 2 can be made smaller (e.g., thinner or narrower) without causing an excessive rise in temperature. Accordingly, the high-frequency power combiner 10 can be miniaturized. For example, the thickness (the size in the Z direction) of the high-frequency power combiner 10 can be reduced.

The insulating liquid 5 is used as the dielectric, and thereby the electric lengths of the output-side line 21 and the input-side lines 22 and 22 become short, compared to the case in which the liquid 5 is not used. For this reason, the size of the internal conductor 2 in the X direction can be reduced. Therefore, the length (the size in the X direction) of the high-frequency power combiner 10 can be reduced. Thus, the high-frequency power combiner 10 can be further miniaturized.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A high-frequency power combiner comprising:

an external conductor that defines an internal space; and an internal conductor having an output-side line and a plurality of input-side lines that branch off from the output-side line, and provided in the internal space of the external conductor, wherein the high-frequency power combiner has a structure capable of storing a liquid in contact with the internal conductor in the internal space.

2. The high-frequency power combiner according to claim 1, wherein an output-side end conductor is connected to the output-side line, an input-side end conductor is connected to each of the input-side lines, insertion holes through which the output-side end conductor and the input-side end conductors are inserted are formed in the external conductor, and the insertion holes are liquid-tightly closed by closing members.

3. The high-frequency power combiner according to claim 1, wherein the external conductor is provided with an inflow passage that introduces the liquid into the internal space, and an outflow passage that leads the liquid from the external conductor.

4. The high-frequency power combiner according to claim 1, wherein the external conductor has a sealed structure.

5. A high-frequency power combiner comprising:

an external conductor capable of storing a liquid in an internal space; and an internal conductor having an output-side line and a plurality of input-side lines that branch off from the output-side line, and provided in the internal space of the external conductor, wherein the high-frequency power combiner has a heat carrier that is an insulating liquid filling the internal space of the external conductor to be able to be in contact with the internal conductor.

* * * * *